United States Patent [19]

Wise

[11] Patent Number: 4,477,067

[45] Date of Patent: Oct. 16, 1984

[54] METHOD AND APPARATUS FOR ASSEMBLING SHEET MATERIAL ASSEMBLAGES

[75] Inventor: James C. Wise, Jackson Springs, N.C.

[73] Assignee: Harris Graphics Corporation, Melbourne, Fla.

[21] Appl. No.: 376,278

[22] Filed: May 10, 1982

[51] Int. Cl.[3] ..... B65H 5/30

[52] U.S. Cl. ..... 270/55; 270/57; 270/58; 271/257

[58] Field of Search ..... 270/55, 12, 54, 57–58, 270/45–51, 17–19; 271/256, 257

[56] References Cited

U.S. PATENT DOCUMENTS

| | | | |
|---|---|---|---|
| 2,461,573 | 2/1949 | Schweizer | 270/55 |
| 2,634,971 | 8/1949 | Schweizer | 270/55 |
| 2,796,255 | 6/1957 | Mitchell | 270/57 |
| 2,911,213 | 11/1959 | Zuercher et al. | 270/57 |
| 3,450,400 | 6/1969 | Guggisberg | 270/55 |
| 3,663,008 | 5/1972 | Pederson | 270/55 |
| 3,825,246 | 7/1974 | Elia et al. | 270/58 |
| 3,874,649 | 4/1975 | Bryson et al. | 270/55 |
| 3,881,716 | 5/1975 | Bryson et al. | 270/12 |
| 3,953,018 | 6/1976 | Maopolski | 270/54 |
| 4,034,947 | 7/1977 | Maopolski | 270/55 |
| 4,168,828 | 9/1979 | McLear | 270/54 |

FOREIGN PATENT DOCUMENTS

| | | | |
|---|---|---|---|
| 2539466 | 3/1977 | Fed. Rep. of Germany | 270/57 |

*Primary Examiner*—E. H. Eickholt

*Attorney, Agent, or Firm*—Yount & Tarolli

[57] ABSTRACT

A method and apparatus for assembling newspapers which have a jacket and a plurality of inserts within the jacket are disclosed. The apparatus includes a circular array of stations and a rotor carrying a plurality of pockets which move below the stations. A two-speed transmission is provided so that the rotor can be driven at either of two speeds. At each station there is a hopper for feeding a jacket or insert into the pockets as they move below. The jacket feeding stations are grouped into a group of two or more adjacent stations. The insert feeding stations are likewise grouped into groups of adjacent stations having two or more in each group. All groups have the same number of stations and the stations in each group all feed an identical jacket or insert. In addition there is a single opener station for opening jackets before inserts are fed into the jackets and a single delivery station for each group of jacket feeding stations. In one embodiment each group includes two stations. There is a single opener station and a single delivery station. The rotor is provided with a plurality of groups of pockets.

22 Claims, 7 Drawing Figures

METHOD AND APPARATUS FOR ASSEMBLING SHEET MATERIAL ASSEMBLAGES

BACKGROUND AND SUMMARY OF THE INVENTION

The present invention relates to a method and apparatus for stuffing newspapers. Particularly the invention provides for stuffing newspapers at a high rate of speed and with an operating flexibility not heretofor possible.

Conventional newspaper stuffing machines include a plurality of fixed feeding stations disposed in a circular array and a plurality of pockets mounted on a rotor which is movable below the stations. In a conventional stuffing machine, at the first of the stations a jacket is fed into each of the pockets. As the rotor turns, the pockets carry the jackets past an opener station where the jackets are opened to prepare them to receive inserts. Subsequent stations have hoppers which feed inserts into each pocket as each pocket moves past the station. At a delivery station each pocket opens to drop the assembled paper onto a conveyor which carries the paper away for further processing. Newspaper stuffing machines of this general type are shown in U.S. Pat. Nos. 2,461,573; 2,634,971; 3,825,246; 3,874,649; 3,881,716; 3,953,018; and 4,168,828.

One such conventional newspaper stuffing machine has 16 stations: one jacket feeding station, one opener station, thirteen insert feeding stations and a delivery station. This stuffer is able to operate at a speed of about 20,000 newspapers per hour. An increase in the speed of a stuffing machine would allow the newspapers to be printed later and therefore to include later news. In some cases, it would be desirable to have the jacket fed directly from the printing press. In this case, the jacket contains the late news while the inserts are either preprinted or also fed directly from a printing press. A conventional newspaper press operating at full speed can deliver about 70,000 newspapers per hour, so a faster stuffer would be clearly advantageous.

U.S. Pat. No. 3,953,018 shows a stuffer which can operate at about 40,000 newspapers per hour. This stuffer also has a total of sixteen stations. There are two jacket feeding stations diametrically opposite each other. An opener station is located immediately adjacent each jacket feeding station. Five insert feeding stations follow each opener station, and there are two delivery stations, one for each group of insert feeding stations. Each delivery station includes a conveyor for carrying the assembled newspapers away. The rotor in this stuffer moves at the same speed as in the machine able to produce 20,000 newspapers per hour (each paper having 1 jacket and 13 inserts), but because there are two jacket feeders and only five inserts per jacket, the newspaper output rate is doubled. Therefore, this machine can produce 40,000 newspapers per hour where each paper comprises one jacket and five inserts. Moreover, in this machine it is possible using the techniques shown in U.S. Pat. No. 3,825,246 to inhibit one of the delivery stations and to use the second jacket feeding station to feed an insert. In this way it is possible to assemble newspapers having a jacket and eleven inserts at a rate of 20,000 newpapers per hour and to deliver them to a single delivery conveyor.

There are some problems not solved by these newspaper stuffing machines. The first is speed. Even though it is possible now to assemble newspapers at 40,000 newspapers per hour, this speed is little more than half the output rate of modern newspaper presses. In addition, there is a great deal of congestion around these newspaper stuffing machines. Each insert feeding station is filled manually with inserts from a pallet on the floor adjacent the machine. Since each station feeds an insert different from the insert fed by the immediately neighboring stations, there are at least ten separate pallets around the machine. Furthermore, in the machine capable of assembling 40,000 newspapers per hour, there are two separate delivery conveyors, and if the assembled newspapers are to be bundled and palletized two separate sets of equipment for these purposes are also required.

The present invention provides great flexibility in the size of newspapers it can assemble and the rate at which it does so. For example, a machine constructed according to the present invention can assemble newspapers at twice the rate that previously had been possible from a stuffing machine having a single delivery conveyor. Specifically, the present invention makes rates of 40,000 newspapers per hour or more possible from a single delivery station and conveyor. In addition, when operating at this high speed the newspapers may be larger than previously possible, having six inserts rather than five with no physical enlargement of the machine. The ability to assemble newspapers using a machine having a single delivery conveyor at the same rate that was only possible in the past using a machine with two delivery conveyors reduces the congestion in the newspaper plant, and can simplify handling of the assembled papers. Moreover, as will become clear from the description below, the arrangement of the stations provided by the present invention also serves to reduce congestion.

According to the present invention, sixteen stations are arranged above a rotor carrying a plurality of pockets. The first two stations are jacket feeding stations, followed by a single opener station, followed by six pairs of insert feeding stations and a single delivery station. In a first mode of operation, the present invention assembles a newspaper having a jacket and six inserts. In this mode the machine is operated as follows: the hopper at the first jacket feeding station feeds a jacket into every other pocket that moves below it (the odd pockets), while the hopper at the second jacket feeding station feeds into the pockets not filled at the first station (the even pockets). The opener station opens the jackets in both the odd and even pockets. Then the hopper at the first of each pair of insert feeding stations feeds an insert into the odd pockets and the hopper at the second of each pair of insert feeding stations feeds an insert into the even pockets as the pockets move past the stations. The single delivery accepts the assembled papers from both sets of pockets. Because the stations are feeding to alternate pockets, it is possible to move the rotor which carries the pockets faster than in prior art stuffers.

Two advantages result from this method and arrangement. First, one delivery station and one opener station necessary in the prior art device have been eliminated. These two stations are now free to be used as insert feeding stations. Therefore, the assembled newspaper can have six inserts instead of five.

The second advantage arises from the fact that the stations are paired with the hoppers of each pair feeding the same insert. As noted above, the hoppers are usually loaded manually from a supply of inserts located on pallets around the machine. Each pallet has a supply of one kind of insert. In a stuffer where the hopper at each station feeds an insert different from that fed at adjacent stations, a separate pallet with an insert supply is required for each station. In the machine provided by the present invention each pair of adjacent hoppers feeds the same kind of insert, so a single pallet of inserts supplies each pair of stations. This reduces by half the number of pallets which must be located around the perimeter of the stuffing machine.

A machine constructed according to the present invention has operating flexibility. It may be operated in a second mode to assemble newspapers with a jacket and twelve inserts. In this case, only one of the jacket feeding stations is used at a time. The hopper at the jacket feeding station feeds a jacket into every pocket, the jacket is opened at the opener station, the hoppers at each of the twelve insert stations feed a different insert, and the delivery station receives the assembled papers and delivers them onto a conveyor.

When operating in the second mode the insert feeding stations are feeding into every pocket, and the rotor moves only one half as fast as in the first mode of operation. The machine includes a two-speed transmission which is shifted to change the rotor speed relative to the hopper speed when changing modes. In addition, the timing, but not the frequency, of the hoppers must be changed when changing modes. Because the rotor speed and hopper timing may be easily changed, it is easy to switch between modes of operation. Thus, the present invention provides a machine with more flexibility than prior art machines.

A second embodiment of the present invention provides a machine with four jacket feeding stations, two openers, eight insert feeding stations and two delivery stations. This machine has the flexibility to operate in four modes, one assembling 80,000 or more newpapers per hour where each newspaper includes a jacket and two inserts delivered to two conveyors. This mode is particularly attractive where the jacket and both inserts are fed directly from a printing press. In a second mode, the machine assembles 40,000 newspapers per hour or more where each newspaper includes a jacket and four inserts delivered to two conveyors. In a third mode, the machine assembles 40,000 newspapers per hour or more where each newspaper includes a jacket and five inserts delivered to a single conveyor; and in a fourth mode, the machine assembles newspapers at the rate of 20,000 newspapers per hour or more where each newspaper includes a jacket and ten inserts.

BRIEF DESCRIPTION OF THE DRAWINGS

These and other features and advantages of the present invention will become clear from the following description taken together with the accompanying drawings in which.

DESCRIPTION OF THE PREFERRED EMBODIMENT

The present invention provides a method and apparatus for stuffing newspapers having different numbers of inserts at different rates. The present invention makes it possible to stuff newspapers having more inserts than prior machines at greater speeds and to deliver the assembled newspapers to a single delivery conveyor. The machine 10 illustrated in FIG. 1 and constructed in accordance with the present invention includes sixteen equally spaced stations 12*a*, 12*b*, 12*c*, 12*d*, 12*e*, 12*f*, 12*g*, 12*h*, 12*i*, 12*j*, 12*k*, 12*l*, 12*m*, 12*n*, 12*o* and 12*p* disposed in a circular array. Proceeding counterclockwise around the machine 10, the first two stations, 12*a* and 12*b*, are jacket feeding stations, the following station 12*c* is an opener station, the next twelve stations 12*d*–12*o* are insert feeding stations, and the last station, 12*p*, is a delivery station.

Figures 2, 3, 4, 5:
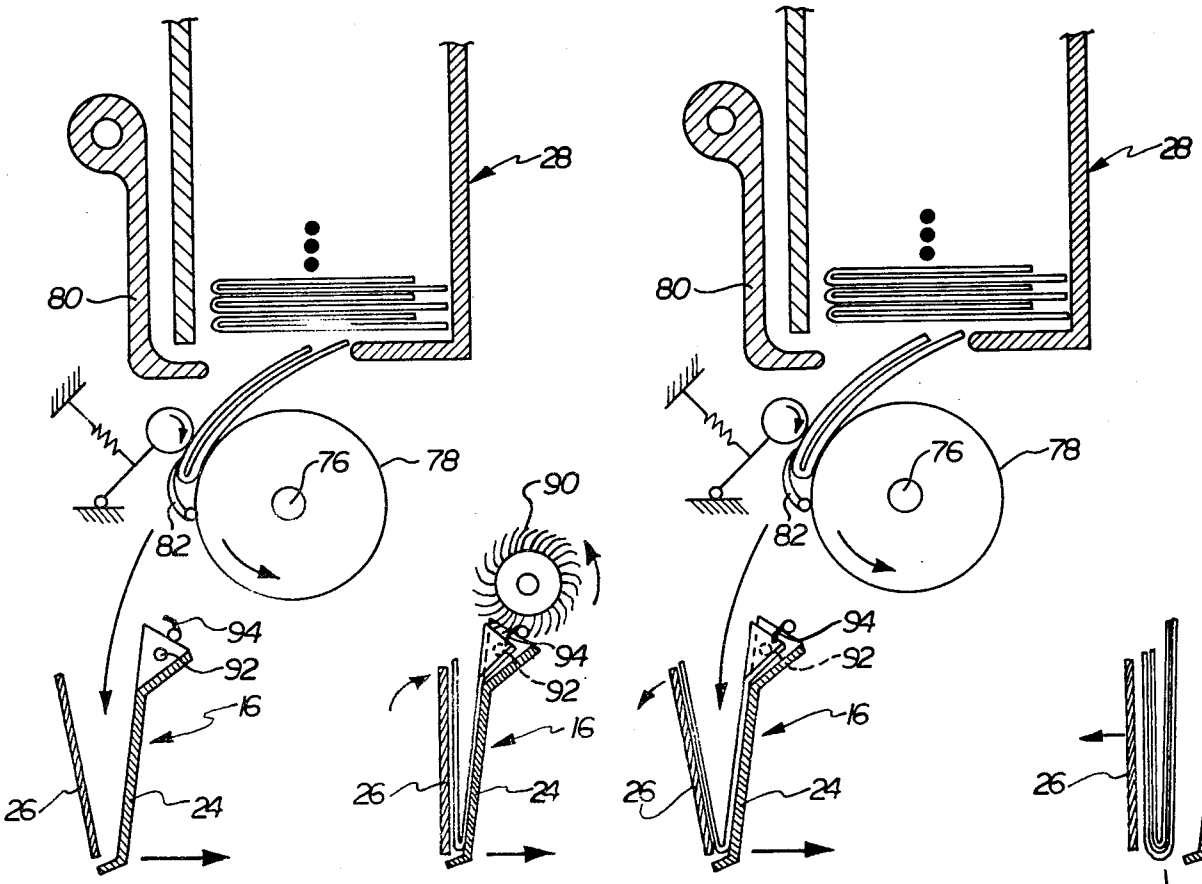
FIG. 2 is a schematic view looking in the direction of arrows 2—2 of FIG. 1.
FIG. 3 is a schematic view looking in the direction of arrows 3—3 of FIG. 1.
FIG. 4 is a schematic view looking in the direction of arrows 4—4 of FIG. 1.
FIG. 5 is a schematic view looking in the direction of arrows 5—5 of FIG. 1.

The stations 12*a*–12*o* are disposed above a rotor 14 carrying seventy-two pockets 16. The rotor 14 may be driven at either one of two speeds by a motor 20 and a two-speed transmission 22 so that the pockets 16 move below each of the stations 12*a*–12*o* in sequence. The transmission 22 may be shifted from one speed to the other by means of lever 23. Each of the pockets 16 (FIG. 2) on the rotor 14 includes two radially extending vertical walls, a fixed wall 24 and an inclined wall 26. The walls 24 and 26 are connected for relative pivoting motion about a horizontal, radially extending axis adjacent their lower extremities. The walls of each pocket 16 define an upwardly facing generally V-shaped opening.

As each pocket 16 passes the feeding stations 12*a* and 12*b*, a V-folded, outermost section of the newspaper, called a jacket, is fed from a hopper 28 into the pocket. Each of the hoppers 28 is connected with and supported by a frame (FIG. 1) formed of eight segments 32*a*, 32*b*, 32*c*, 32*d*, 32*e*, 32*f*, 32*g*, 32*h* joined together. Each segment 32*a*–32*h*, carries a gear box 34*a*, 34*b*, 34*c*, 34*d*, 34*e*, 34*f*, 34*g*, 34*h*, respectively, each of which drives the hoppers 28 at a pair of adjacent stations. The motor 20 (FIG. 1) is connected with and drives gear box 34*g* which in turn drives the hoppers at stations 12*m* and 12*n*. The gear box 34*g* has a vertical output shaft 36 which drives a pulley 42 which in turn drives timing belts 44 which interconnect all gear boxes 34*a*–34*h* in all of the segments 32*a*–32*h*.

Figure 7:
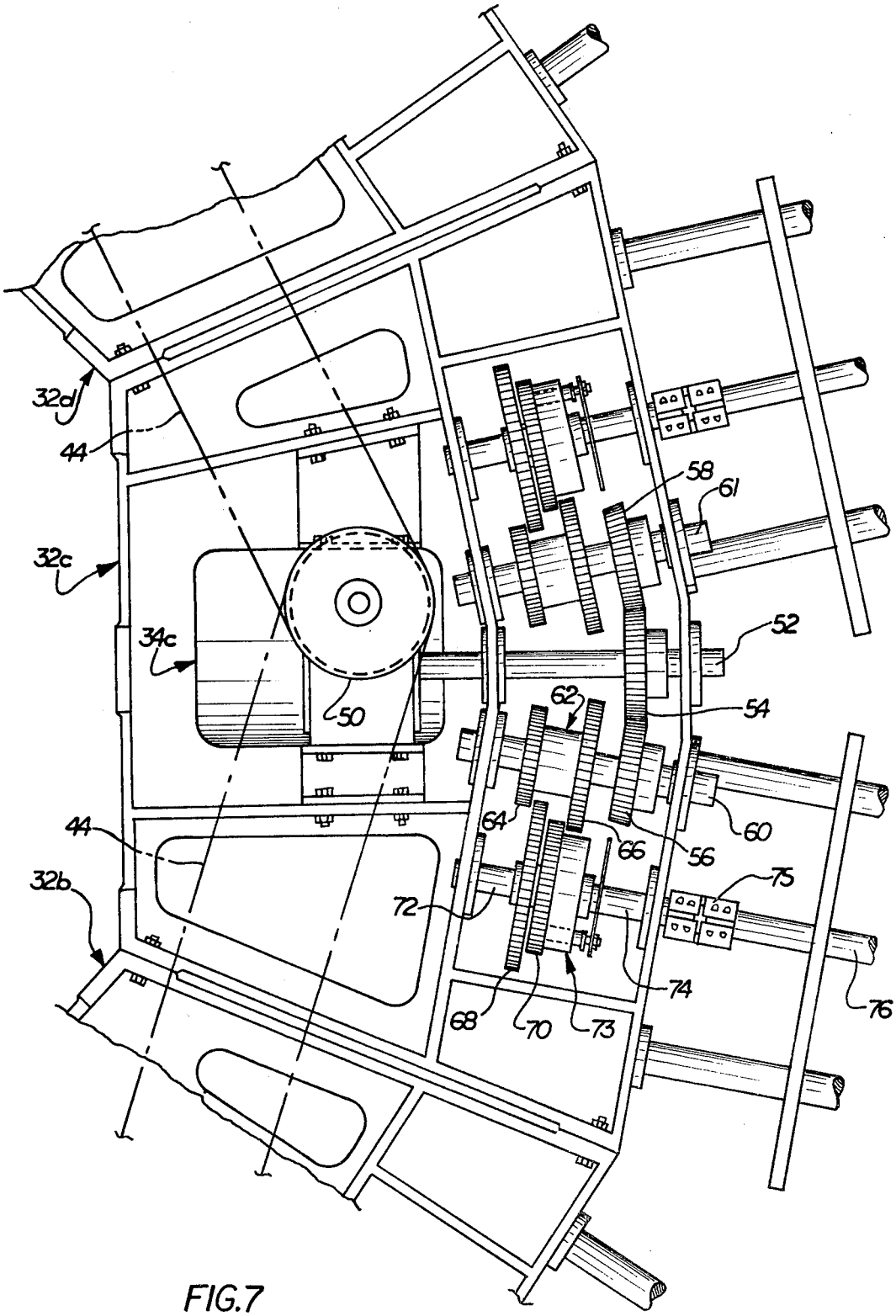
FIG. 7 illustrates a portion of a drive mechanism for two adjacent hoppers.

FIG. 7 illustrates the segment 32*c* in detail. Timing belt 44 drives pulley 50 which drives shaft 52 through gear box 34*c*. The shaft 52 carries a bevel gear 54 which drives bevel gears 56 and 58 on shafts 60 and 61, respectively. Since the bevel gear 58 and the mechanism it drives are substantially the same as the gear 56 and the gear it drives, only the latter will be described, it being understood that the description applies equally to the former.

Gear 56 is fixed to shaft 60, and shaft 60 also carries a pair of gears 64 and 66 cooperating with gears 68 and 70, respectively, on shaft 72. The gears 64 and 66 are axially slidable on shaft 60 to bring either gear 64 into engagement with gear 68 (which effects a 2 to 1 speed reduction) or gear 66 into engagement with gear 70 (in which case shafts 60 and 72 turn at the same speed). Shaft 72 is coupled through a torque limiting clutch 73 to shaft 74 which in turn is connected by a coupling 75 with shaft 76. Shaft 76 drives a drum 78 (FIGS. 1 and 2) in which is part of the feeding mechanism of the hopper 28.

A drive mechanism like the one described drives each of the hoppers 28 to feed a jacket or insert in a conventional manner. To begin the feed cycle, a finger 80 (FIG. 2) supporting a portion of the bottom of the stack of jackets or inserts in the hopper temporarily withdraws allowing one jacket to drop on to the drum 78. This operation is synchronized with the location and operation of a gripping finger 82 which clamps the jacket or insert to the drum 78 and carries the jacket or insert down toward the pocket 16, whereupon the gripper finger 82 releases the jacket or insert which then falls into the pocket.

The gears 64, 66, 68 and 70 make it possible to drive any of the hoppers 28 at either of two speeds, and this is conventional practice to accommodate difficult to feed inserts. When, because of the bulk or stock or both of a particular insert, an insert is especially difficult to feed, it is common practice to place two identical stacks of such inserts in adjacent hoppers and to have these two hoppers feed into alternate pockets. This is accomplished by changing the gears driving these two hoppers so that they operate at one half the speed of the remaining hoppers. The timing of the operation of these two hoppers may be changed so that the inserts they feed reach their designated pockets at the proper moment.

Once a jacket is in the pocket 16, the pocket moves past the opener station 12*c* (FIG. 3) where a brush 90, vacuum cup 92 (FIG. 2), and cam operated clamp 94 hold one half of the jacket against the upright wall 24 while the other half of the jacket falls against the inclined wall 26 of the pocket 16. The jacket is thus sufficiently unfolded to allow additional newspaper sections, called inserts, to be fed at succeeding stations (FIG. 4) 12*d*–12*o* into the pocket as it moves below.

When the pocket 16 reaches the delivery station 12*p*, (FIG. 5) the movable wall 16 pivots away from the fixed wall to open the bottom of the pocket. The jacket and inserts then drop downwardly onto a delivery conveyor 36 which carries them away for further processing.

The general construction of the rotor 14 and the stations 12*a*–12*p* is the same as that shown and described in U.S. Pat. No. 3,663,008, and the disclosure of that patent is incorporated herein by reference.

Although the construction of the individual stations 12*a*–12*p* and the pockets 16 is generally the same as in U.S. Pat. No. 3,663,008, the present invention calls for a different arrangement of the stations and produces greater flexibility and speed than was possible heretofor. Specifically, one preferred embodiment of the stuffing machine 10 has two adjacent jacket feeding stations 12*a* and 12*b*, and only a single opener station 12*c* and only a single delivery station 12*p*. The machine 10 has a two-speed transmission 22 driving the rotor 14, and the machine is operable in two modes, one with the transmission in high gear and one in low gear. In the first mode the machine 10 assembles and delivers to a single conveyor newspapers having a jacket and six inserts at a rate of 40,000 per hour or more, and in the second mode the machine assembles and delivers to a single conveyor newspapers having a jacket and twelve inserts at a rate of 20,000 per hour or more.

Figure 1:
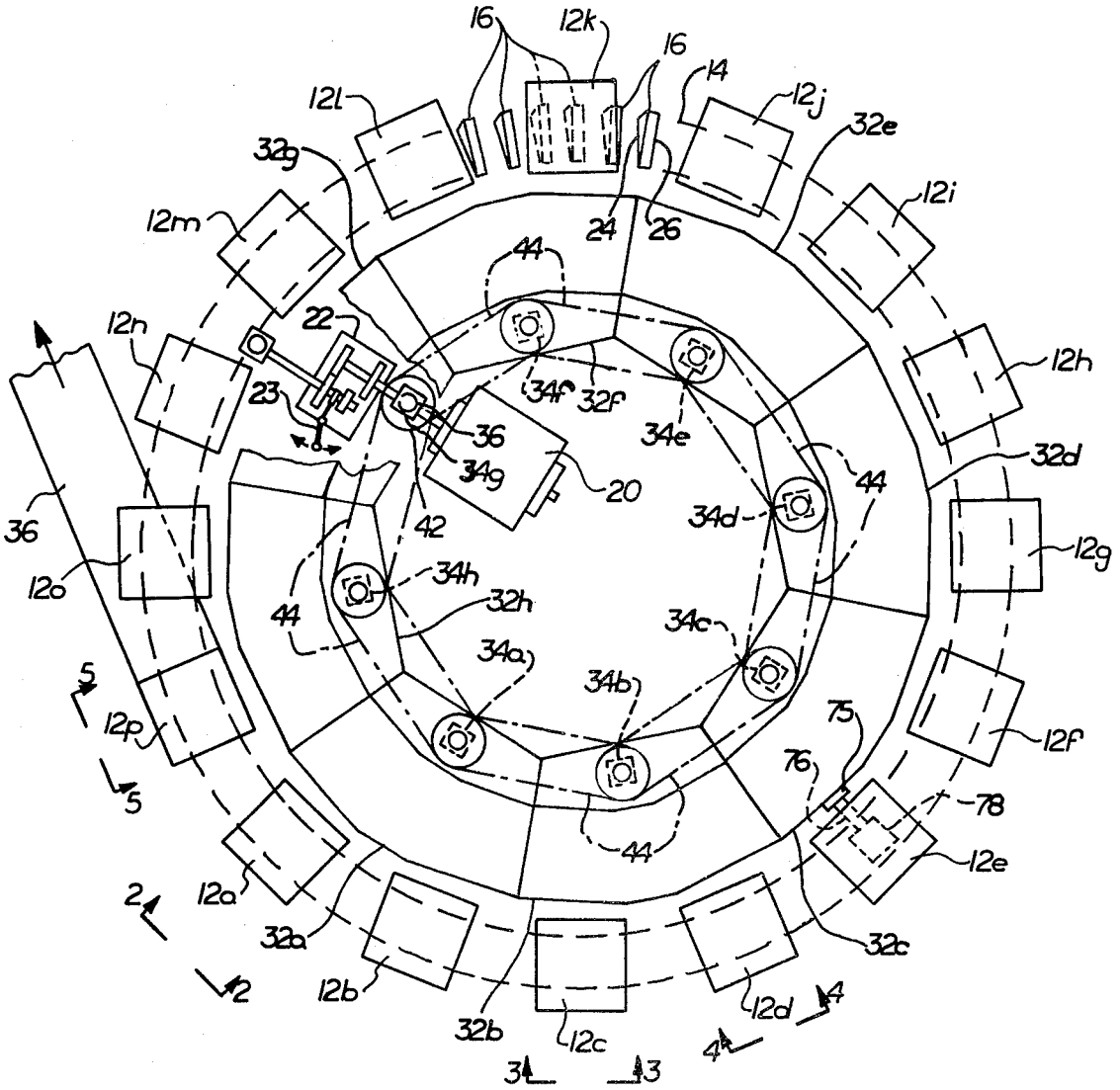
FIG. 1 is a schematic plan view of a newspaper stuffing machine constructed in accordance with the present invention.

Referring to FIG. 1, the machine 10 is operated in a first mode to assemble and deliver to a single conveyor 36 newspapers having a jacket and six inserts at a rate of 40,000 per hour or more as follows. The hoppers at stations 12*a* and 12*b* are operated to feed a jacket into alternate pockets 16 as the rotor 14 moves the pockets beneath the stations 12*a* and 12*b* with the transmission 22 shifted into high gear by means of lever 23. As the pockets carry the jackets past opener station 12*c*, the inclined pocket wall 26 folds towards the fixed pocket wall 24 (FIG. 3) while the brush 90 and the vacuum sucker 92 operate to move one side of the folded newspaper jacket toward the clamp 94. When the side of the newspaper jacket has been clamped into position, the movable wall 26 moves away from the fixed wall, thereby opening the newpaper jacket. The single opener station 12*c* opens the jackets from both delivery stations 12*a* and 12*b*.

The twelve remaining insert feeding stations, 12*d*–12*o* operate in pairs, the hoppers at each pair of stations feeding the same insert, and one hopper of each pair feeding alternate pockets while the other hopper of each pair feeds the remaining pockets. Thus, for example, the hoppers at stations 12*d* and 12*e* feed the same insert, but the hopper at station 12*d* feeds inserts into the pockets fed at station 12*a*, while the hopper at station 12*e* feeds inserts into the pockets fed at station 12*b*. Likewise, stations 12*f* and 12*g* are paired, the hopper at each feeding the same insert but into alternate pockets. The hopper at station 12*f* feeds inserts into the same pockets that the hopper at station 12*d* fed into, i.e. the pockets fed by station 12*a*. The hopper at station 12*g* feeds inserts into the same pockets that station 12*e* fed into, i.e. the pockets fed by station 12*b*. In a like manner, stations 12*h* and 12*i* are paired, stations 12*j* and 12*k* are paired, stations 12*l* and 12*m* are paired, and stations 12*n* and 12*o* are paired.

The pairing of the stations so that hoppers at adjacent stations feed the identical inserts reduces congestion around the machine 10. Specifically, the inserts supplied to each station are generally manually taken from a pallet on the floor adjacent to the station. In a machine 10 constructed in accordance with the present invention, a single pallet supplies each pair of stations. Therefore, for example, stations 12*d* and 12*e* may be supplied from a single pallet. In prior art constructions, where no two adjacent stations fed the identical insert, it was necessary to have one pallet for every station. In the machine 10 constructed according to the present invention, it is necessary only to have one pallet for each pair of stations, thereby reducing the number of pallets by half.

When the last pair of stations 12*n* and 12*o* have fed inserts into the jackets, the movable wall 26 of the pockets 16 pivots away from the fixed wall to open the bottom of the pocket. The assembled newspapers then move downward onto a delivery conveyor 36 and are carried away for further processing.

The machine 10 may also be operated in a second mode in which it assembles newspapers having a jacket and 12 inserts at the rate of 20,000 per hour or more. When operating in this mode, the transmission 22 is placed in low gear so that the rotor 14 turns one half as fast as when operating in high gear.

In addition to shifting the transmission 22, the timing of the operation of the hoppers 28 must also be changed so that the delivery of the jackets and inserts is properly synchronized with movement of the pockets 16. When operating in this second mode, all the hoppers 28 are retarded approximately 30° from the timing of their operation in the first, high speed mode. To make this adjustment, the coupling 75 (FIG. 7) is loosened and the shaft 76 is manually rotated with respect to shaft 74 and then the coupling is retightened. Additional adjustments to individual hoppers may be required in either mode of operation to compensate for the properties of the jacket or insert being fed, as is well known to those skilled in the art.

In the second, slower mode, only one of the jacket feeding stations 12*a* or 12*b* is utilized, and the hopper there feeds a jacket into every pocket 16. Thereafter, the jacket 16 is opened at the opener station 12*c*, and the hopper at each of the insert feeding stations 12*d*–12*o* feeds a different insert into the jacket. Alternatively, both of the jacket feeding stations 12*a* and 12*b* may be utilized to put jackets into the pockets 16. This is especially useful where the jackets are relatively thick and difficult to feed. U.S. Pat. No. 3,953,018 discloses a newspaper stuffer having dual jacket feeding stations, and its disclosure is incorporated by reference.

After the jacket has been stuffed with twelve inserts, the pockets 16 open at the delivery station 12*p*, and the assembled newspapers are delivered onto the delivery conveyor 36. Because the insert feeding stations 12*d*–12*o* are feeding every pocket, rather than alternate pockets as in the previous mode of operation, it is necessary for the rotor to move slower. To this end, the lever 23 is operated to shift the transmission 22 into low gear so that the rotor moves at one-half its rotational speed when in the first described mode.

Figure 6:
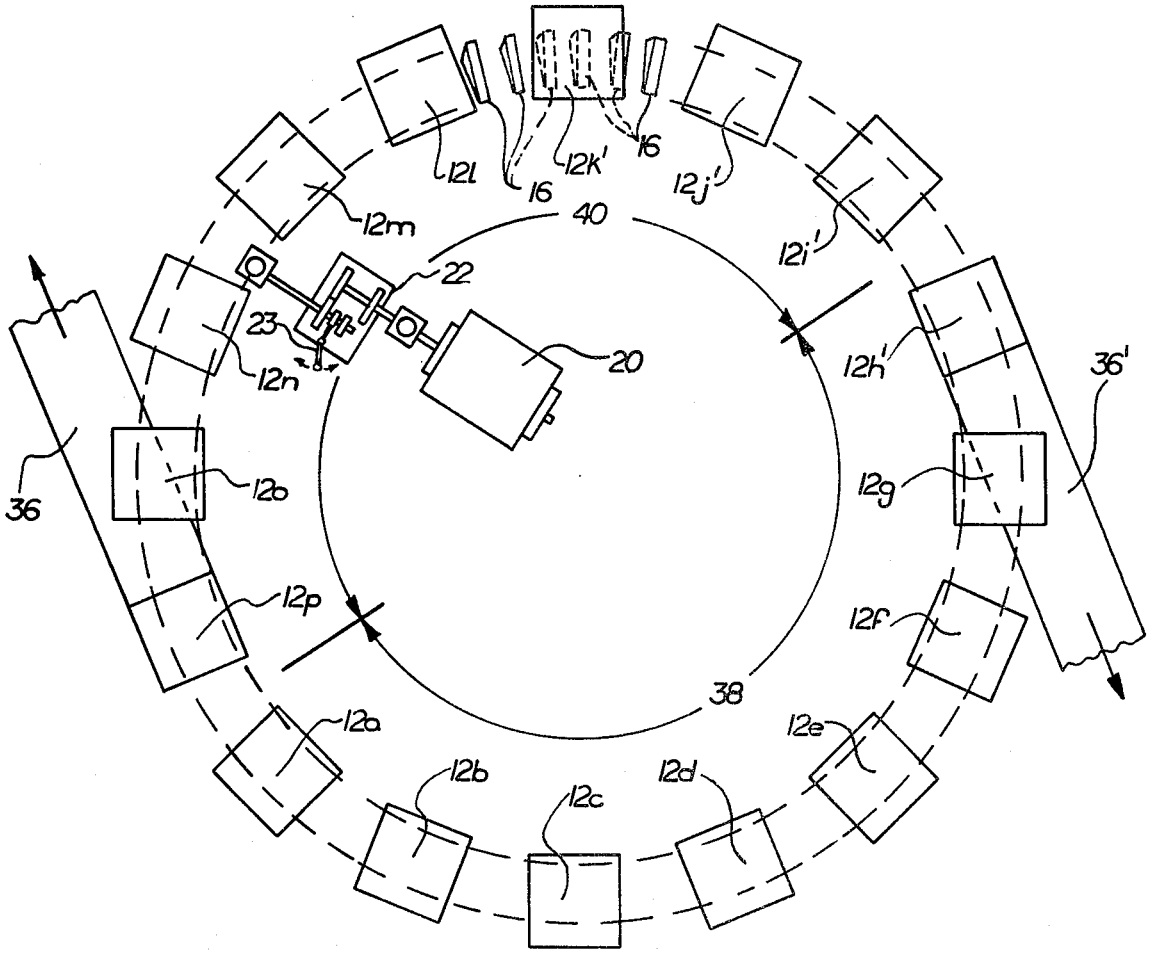
FIG. 6 illustrates a second embodiment of the present invention.

A second preferred embodiment of the present invention illustrated in FIG. 6 is generally similar to the stuffing machine 10 that is illustrated in FIG. 1 except that four of the insert feeding stations 12*h*, 12*i*, 12*j*, and 12*k* of the stuffer machine 10 illustrated in FIG. 1 have been replaced with a delivery station 12*h*', a jacket feeding station 12*i*', a jacket feeding station 12*j*', and an opener 12*k*', respectively. Because the machine 10' is generally similar to the machine 10 illustrated in FIG. 1 the same reference numerals will be used with a prime (') added to indicate parts which are different.

The machine 10' also has a two-speed rotor transmission 22 and is also operable in a plurality of modes, a first mode in which newspapers having a jacket and two inserts are delivered to two delivery conveyors at a combined rate of 80,000 per hour or more, a second mode in which newspapers having a jacket and five inserts are delivered to two delivery conveyors at the rate of 40,000 per hour or more, a third mode in which newspapers having a jacket and five inserts are delivered to a single conveyor at the rate of 40,000 per hour or more and a fourth mode in which newspapers having a jacket and 10 inserts are delivered to a single conveyor at the rate of 20,000 per hour or more.

The machine 10' can be divided into two halves 38 and 40. The half 38 includes jacket feeding stations 12*a* and 12*b*, opener station 12*c*, insert feeding stations 12*d*–12*g*, and delivery station 12*h*' including delivery conveyor 36'. The opposite half 40 includes jacket feeding stations 12*i*' and 12*j*', opener station 12*k*', insert feeding stations 12*l*–12*o* and delivery station 12*p*.

As noted above, the machine 10' (FIG. 6) can deliver newspapers having a jacket and two inserts to two delivery conveyors 36 and 36' at an aggregate rate of 80,000 newspapers per hour or more. When operating in this mode, each machine half 38 and 40 delivers 40,000 newspapers per hour or more. At jacket feeding stations 12*a* and 12*b* jackets are fed into alternate hoppers in the manner described above. The opener station 12*c* then opens all the jackets, and at the insert feeding stations 12*d* and 12*f* inserts are fed into the jackets fed from jacket feeding station 12*a*, while at the insert feeding stations 12*e* and 12*g* inserts are fed into the jackets fed from jacket feeding station 12*b*. Thereafter, the pockets are opened and the assembled newspapers delivered at delivery station 12*h*' onto delivery conveyor 36'. Because the feeding stations 12*a*, 12*b*, and 12*d*–12*g*, are feeding alternate pockets, the rotor 14 can move at double speed, and to this end the transmission 22 is placed in high gear.

The opposite half 40 of the machine 10' operates in a similar manner. Since each half of the machine is delivering assembled newspapers comprising a jacket and two inserts at the rate of 40,000 per hour or more, the aggregate output of the machine 10' operating in this mode is 80,000 newspapers per hour or more.

The machine 10' may be operated in a second mode in which it produces a total of 40,000 newspapers per hour or more at two delivery conveyors 36 and 36' where each newspaper comprises a jacket and four inserts. When operating in this mode the jacket feeding stations 12*a* and 12*b* are operated to put a jacket in every pocket 16 and the opener station 12*c* then opens the jackets. Thereafter, a different insert is fed into each of the jackets at the insert feeding stations 12*d*–12*g*, a total of four inserts. Thereafter the assembled newspapers are delivered at delivery station 12*h*' onto delivery conveyor 36' at the rate of 20,000 newspapers per hour or more. The diametrically opposite half 40 of the machine 10' operates in a similar manner.

Because every insert feeding station 12*d*–12*g* is feeding into each pocket 16, the rotor 14 must move at its relatively slower speed, and to this end the transmission 22 is placed in low gear. Because the diametrically opposite halves 38 and 40 of the machine are each producing newspapers at the rate of at least 20,000 per hour, the combined output of the conveyors 36 and 36' is at least 40,000 newspapers per hour where each newspaper comprises a jacket and four inserts.

The stuffer machine 10' illustrated in FIG. 6 may be operated in two other modes in which the delivery station 12*h*' is not utilized and the opener 12*k*' is also not utilized. In this case, the two modes correspond generally to the two modes of operation of the stuffing machine 10 illustrated in FIG. 1. Thus the machine 10' (FIG. 6) may be operated using only a single delivery station 12*p* and a single delivery conveyor 36. The delivery station 12*h*' is inhibited so that the pockets 16 do not open and deliver onto the conveyor 36'. In addition, the opener station 12*k*' is also inhibited. U.S. Pat. No. 3,825,246 discloses a stuffing machine which has the capacity to inhibit the operation of any of its stations and the disclosure of this patent is incorporated by reference.

When the delivery and opener stations 12*h*' and 12*k*' are inhibited, there remain two jacket feeding stations 12*a* and 12*b*, and opener station 12*c*, ten insert feeding stations 12*d*–12*g*, 12*i*, 12*j*, 12*l*–12*o* and a delivery station 12*p*. If these ten stations are used each to feed a different insert, the machine 10' can assemble a newspaper comprising one jacket and ten inserts and deliver the assembled newspapers to a single conveyor 36 at the rate of 20,000 per hour or more. The ten insert feeding stations 12*d*–12*g*, 12*i*, 12*j*, and 12*l*–12*o* may also be grouped into five pairs with each pair feeding a different insert. When operated in this mode, the hopper at first of each pair of insert feeding stations, 12*d*, 12*f*, 12*i*, 12*l*, and 12*m*, feeds inserts into the jackets fed from station 12*a*. The hoppers at the remaining insert feeding stations feed inserts into the jackets fed from station 12*b*. When operated in this mode, the machine 10' can assemble newspapers comprising one jacket and five inserts and deliver them to a single delivery at the rate of 40,000 per hour or more.

Thus it is clear that the present invention provides for assembling newspapers with greater flexibility than in the past, including a mode operating twice as fast as previously possible from a stuffing machine having a single delivery conveyor. In addition, when operating at this high speed, the newspapers may be larger than previously possible, having six inserts rather than five with no physical enlargement of the machine. Moreover, the same machine has a second, slower mode in which larger newspapers are assembled. The ability to assemble newspapers using a machine having a single delivery conveyor at the same rate that was only possible in the past using a machine with two delivery conveyors reduces the congestion in the newspaper plant, and can simplify handling of the assembled papers and the inserts which form them.

A second embodiment of the present invention at least quadruples the output rate over prior known stuffers and provides the flexibility and speed to enable online printing and stuffing of several newspaper sections or the assembly of a jacket with many preprinted inserts.

Although the invention has been described as embodied in newspaper stuffing machines which have adjacent pairs of stations which can feed identical jackets and inserts, the invention is not limited to two adjacent stations which feed into alternate pockets of a rotor. Thus for example, a newspaper stuffer could be constructed embodying the present invention in which there were three consecutive jacket feeding stations followed by an opener station followed by triplets of insert feeding stations followed by a single delivery station. In such a stuffing machine each jacket feeding station would feed every third pocket. Similarly, the first of each triplet of insert feeding stations would feed an insert into the first of every three pockets in the rotor. The second insert feeding station would feed an identical insert into the second of every three pockets in the rotor; and the third of each triplet of insert feeding stations would feed an identical insert into the third of every three pockets in the rotor.

Obviously, the present invention could be applied to machines having multiples of four or more adjacent stations which feed the identical jacket or insert. In its broadest generality, the present invention could be embodied in a machine having a group of n adjacent jacket feeding stations and a plurality of groups of n insert feeding stations, where n is a number equal to at least two (2). A single opener station is located between the group of jacket feeding stations and the first group of insert feeding stations. The rotor carries a plurality of groups of n pockets. The machine is operated so that as the pockets move below the stations, each hopper in the group of n jacket feeding stations and each hopper in the plurality of groups of n insert feeding stations feeds a jacket or insert, respectively, into a corresponding one of the pockets in each of the plurality of groups of n pockets.

Moreover, although the present invention is described as embodied in machines having one or two delivery conveyors 36 and 36', it is contemplated that three or more delivery conveyors could be utilized.

Though the invention has been described as embodied in newspaper stuffing machines, it is also applicable to various other types of sheet material assembling and collating apparatus such as flat-back and saddle type assemblers and collators. The invention embodied in a flat-back or saddle type machine would have a group of n adjacent first sheet material feeding stations and a plurality of groups of n other sheet material feeding stations where n is a number equal to at least two (2). A support means moves adjacent the feeding stations at n selectable speeds. A selected speed registers a feed location on the support means for a first sheet material to a corresponding feed location on the support for associated other sheet material. As the machine is operated, each hopper in the group of n first sheet material feeding stations and each hopper in the group of n other sheet material feeding stations feeds a first material sheet and other sheet material, respectively, to a corresponding feed location on the support means.

The following is claimed:

1. A method of assembling newspapers having a jacket and a plurality of inserts in the jacket, said method comprising the steps of providing a pair of adjacent jacket feeding stations each having a jacket feeding hopper; providing each jacket feeding hopper with a supply of jackets identical to each other; providing a plurality of pairs of adjacent insert feeding stations each having an insert feeding hopper; providing a plurality of pairs of pockets for receiving jackets and inserts from the hoppers at the stations; providing each pair of insert feeding hoppers with a supply of inserts identical to each other; selecting one of two speeds for moving said pockets below said stations; moving the pockets sequentially below the stations at the selected speed; feeding a jacket from one of the hoppers at the pair of jacket feeding stations and an insert from one of the hoppers at each pair of insert feeding stations into one of each pair of pockets; and feeding a jacket identical to the jacket fed by the one jacket feeding hopper from the other of the hoppers at the pair of jacket feeding stations and an insert identical to the insert fed by the one of each pair of insert feeding hoppers from the other of the hoppers at each pair of insert feeding stations into the other of each pair of pockets.

2. A method as set forth in claim 1 further including the step of opening the jackets fed by the pair of jacket feeding hoppers after both the jackets are in their respective pockets.

3. A method as set forth in claim 2 further including the step of delivering the newspapers from the pockets to a single delivery conveyor.

4. A method as set forth in claim 3 wherein said step of feeding a jacket from one of the hoppers at the pair of jacket feeding stations and an insert from one of the hoppers at each pair of insert feeding stations into one of each pair of pockets and said step of feeding a jacket from the other of the hoppers at the pair of jacket feeding stations and an insert from the other of the hoppers at each pair of insert feeding stations into the other of each pair of pockets include the step of feeding an identical jacket from the hoppers at said pair of jacket feeding stations and feeding an identical insert from the hoppers at each pair of stations.

5. An apparatus for assembling newspapers comprising a pair of adjacent jacket feeding stations, each of said jacket feeding stations including a hopper for feeding a jacket, a plurality of pairs of insert feeding stations, each of said insert feeding stations including a hopper for feeding an insert and the stations of each pair being adjacent to each other, a rotor having a plurality of pockets for receiving jackets and inserts from said hoppers, drive means for turning said rotor to move said pockets relative to said stations at either one of two speeds, an opener for opening the jackets fed by said jacket feeding hoppers, and a delivery station for receiving assembled newspapers from one of said pockets.

6. An apparatus as defined in claim 5 wherein said opener is disposed adjacent one of said pair of jacket feeding stations and said delivery station is disposed adjacent the other of said jacket feeding stations.

7. An apparatus as defined in claim 6 further including means for manually selecting the one of said two speeds at which said drive means moves said rotor relative to said stations.

8. An apparatus as defined in claim 7 including drive means for individually driving each of said hoppers at either one of two speeds relative to said selected rotor speed.

9. A method of assembling sheet material assemblages having a jacket and a plurality of inserts in the jacket, said method comprising the steps of providing a group of adjacent jacket feeding stations, each jacket feeding station having a hopper for feeding a jacket, the jackets fed from each hopper being identical, providing a plurality of groups of adjacent insert feeding stations, each insert feeding station having a hopper for feeding an insert, the inserts fed from the hoppers in each group being identical, the number n of jacket feeding stations in said group and the number of insert feeding stations in each one of said groups being equal, providing a plurality of pockets for receiving jackets and inserts from the hoppers at the stations, moving said plurality of pockets sequentially past said group of adjacent jacket feeding stations and said plurality of groups of insert feeding stations at a speed selected from a number of speeds, the number of speeds corresponding to said number n, and feeding a jacket and an insert from a respective one of said hoppers in said group of adjacent jacket feeding stations and from a respective one of said hoppers in each of said groups of adjacent insert feeding stations into a pocket as said pockets move past said hoppers.

10. A method as set forth in claim 9 further including the step of opening the jackets fed from the hoppers at each of said group of adjacent jacket feeding stations after a jacket has been fed into each of the pockets.

11. A method as set forth in claim 9 further including the step of delivering the sheet material assemblages from the pockets to a single delivery conveyor.

12. A method as set forth in claim 9 further including the step of selecting one of said n number of speeds at which to drive said hoppers relative to the speed of movement of said pockets.

13. A method as set forth in claim 9 further comprising the steps of providing a second group of n adjacent jacket feeding stations, each second jacket feeding station having a hopper for feeding a jacket, the jackets fed from each hopper of the second jacket feeding station being identical, providing a second plurality of groups of n adjacent insert feeding stations, each second insert feeding station having a hopper for feeding an insert, the inserts fed from the hoppers in each second group being identical, each plurality of groups of n adjacent insert feeding stations located between each group of n adjacent jacket feeding stations, providing a second plurality of pockets for receiving jackets and inserts respectively from said second group of n adjacent jacket feeding stations and said second plurality of groups of n adjacent insert feeding stations, moving said second plurality of pockets sequentially past said second group of n adjacent jacket feeding stations and said second plurality of groups of n adjacent insert feeding stations at said selected speed and feeding a jacket and an insert from a respective one of said hoppers in said second group of adjacent jacket feeding stations and from a respective one of said hoppers in each of said second group of adjacent insert feeding stations into a pocket of said second plurality of pockets moving past hoppers of said second group of adjacent jacket feeding stations and said second plurality of groups of adjacent insert feeding stations.

14. A method as set forth in claim 13 comprising the step of delivering the sheet material assemblages from said second plurality of pockets to a second delivery conveyor.

15. An apparatus for assembling sheet material assemblages which have a jacket and a plurality of inserts, said apparatus comprising a group of adjacent jacket feeding stations, the number n of adjacent jacket feeding stations in said group of adjacent jacket feeding stations being equal to at least two, each of said jacket feeding stations having a hopper for holding a supply of jackets identical to the jacket held by the hoppers at the other jacket feeding stations, a plurality of groups of adjacent insert feeding stations, each of said insert feeding stations in a respective group having a hopper for holding a supply of inserts identical to the inserts held in the other hoppers of said respective group, the number of insert feeding stations in each group of adjacent insert feeding stations being equal to said n, a plurality of pockets for receiving jackets and inserts from said jacket and insert hoppers, drive means for moving said plurality of pockets sequentially past said jacket feeding and insert feeding stations at a number of speeds corresponding to said n number and means for selecting one of said n number of speeds, and feeding means for feeding a jacket from one of said hoppers at said adjacent jacket feeding stations and for feeding an insert from one of said hoppers in each of said groups of adjacent insert feeding stations into a pocket of said plurality of pockets as said pockets move past said hoppers.

16. An apparatus a set forth in claim 15 further including opener means disposed between said group of adjacent jacket feeding stations and the first of said groups of adjacent insert feeding stations for opening the jackets fed from each of said hoppers at said group of adjacent jacket feeding stations.

17. An apparatus as set forth in claim 15 further including delivery means for receiving assembled sheet material assemblages from each of said pockets and conveying said sheet material assemblages away, said delivery means being disposed between the last of said groups of adjacent insert feeding stations and said group of adjacent jacket feeding stations.

18. An apparatus a set forth in claim 15 wherein said feeding means includes means for individually selecting one of said n number of speeds at which to drive said feeding means relative to the selected speed of said pockets.

19. An apparatus as set forth in claim 15 comprising a second group of n adjacent jacket feeding stations, each jacket feeding station in said second group having a hopper for holding a supply of jackets identical to the jackets held by hoppers of adjacent jacket feeding stations, a second plurality of groups of n adjacent insert feeding stations, each insert feeding station in respective one of said second plurality of groups having a hopper for holding a supply of inserts identical to the inserts held in the other hoppers of said respective second plurality of groups, each plurality of groups of adjacent insert feeding stations being located between each group of adjacent jacket feeding stations, and a second plurality of pockets operatively connected to said drive means for receiving jackets and inserts from hoppers of said second group of jacket feeding stations and said second plurality of groups of insert feeding stations as said second plurality of pockets move sequentially past said second group of jacket feeding stations and said second plurality of groups of insert feeding stations at said selected speed, said feeding means also feeding a jacket and an insert from one of the hoppers in each of said second group of jacket feeding stations and second plurality of groups of insert feeding stations into a pocket of said second plurality of pockets as said second plurality of pockets move past hoppers of said second group of jacket feeding stations and said second plurality of groups of adjacent insert feeding stations.

20. An apparatus as set forth in claim 19 further including a second delivery conveyor for receiving sheet material assemblages from the pockets of said second plurality of pockets, each delivery conveyor being disposed between the last of a respective plurality of groups of insert feeding stations and a group of adjacent jacket feeding stations.

21. A method of assembling sheet material assemblages having a first sheet material and a plurality of other sheet materials, said method comprising the steps of providing a group of adjacent first sheet material feeding stations, each first sheet material feeding station having a hopper for feeding first sheet material, the first sheet material fed from each hopper being identical, providing a plurality of groups of adjacent other sheet material feeding stations, each other sheet material feeding station having a hopper for feeding other sheet material, the other sheet materials fed from the hoppers in each group being identical, the number n of first sheet material feeding stations in said group and the number of said other sheet material feeding stations in each one of said groups being equal, providing support means for receiving first sheet material and other sheet material from the hoppers at the stations, moving said support means past said group of adjacent first material feeding stations and said plurality of groups of adjacent other sheet material feeding stations at a speed selected form a number of speeds, said number of speeds corresponding to said n number, selected speed registering a feed location on said support means for a first sheet material to a corresponding feed location on said support means for associated other sheet material, and feeding a first sheet material and other sheet material from a respective one of said hoppers in said group of adjacent first sheet material feeding stations and from a respective one of said hoppers in each of said groups of adjacent other sheet material feeding stations to said corresponding feed locations on said support means as said support means moves past said hoppers.

22. An apparatus for assembling sheet material assemblages which have a first sheet material and a plurality of other sheet materials, said apparatus comprising a group of adjacent first sheet material feeding stations, the number n of adjacent first sheet material feeding stations in said group of adjacent first sheet material feeding stations being equal to at least two, each of said first sheet material feeding stations having a hopper for holding a supply of first sheet materials identical to the first sheet materials held by the hoppers at the other first sheet material feeding stations, a plurality of groups of adjacent other sheet material feeding stations, each of said other sheet material feeding stations in a respective group having a hopper for holding a supply of other sheet material identical to the other sheet materials held in the other hoppers of the respective group, the number of other sheet material feeding stations in each group of adjacent other sheet material feeding stations being equal to said n, support means for receiving first sheet materials and other sheet materials respectively from said first sheet material and other sheet material hoppers, drive means for moving said support means past said first sheet material feeding and other sheet material feeding stations at a number of speeds corresponding to said n number and for selecting one of said n speeds, a selected speed registering a first sheet material feed location on said support means to a corresponding feed location on said support means for associated other sheet material feeding stations, and feeding means for feeding first sheet material from one of said hoppers at said adjacent first sheet material feeding stations and for feeding other sheet material from one of said hoppers in each of said groups of adjacent other sheet material feeding stations to a respective feed location on said support means as said support means moves past said hoppers.

* * * * *